United States Patent [19]

Ward, Jr.

[11] 4,001,922

[45] Jan. 11, 1977

[54] TAPE REINFORCEMENTS FOR SLIDE FASTENERS

[75] Inventor: H. Blair Ward, Jr., Guys Mills, Pa.

[73] Assignee: Textron Inc., Providence, R.I.

[22] Filed: Nov. 3, 1975

[21] Appl. No.: 628,310

[52] U.S. Cl. ..... 24/205.11 F

[51] Int. Cl.[2] ..... A44B 19/36

[58] Field of Search ..... 24/205.11 F

[56] References Cited

UNITED STATES PATENTS

| | | | |
|---|---|---|---|
| 2,273,773 | 2/1942 | Pouy | 24/205.11 F |
| 3,030,684 | 4/1962 | Johns | 24/205.11 F |
| 3,190,779 | 6/1965 | Porepp | 24/205.11 F |
| 3,377,668 | 4/1968 | Carlile | 24/205.11 F |
| 3,490,970 | 1/1970 | Heinberger | 24/205.11 F |
| 3,616,939 | 11/1971 | Potin | 24/205.11 F |
| 3,698,064 | 10/1972 | Uhrig | 24/205.11 F |
| 3,922,761 | 12/1975 | Schwendt | 24/205.11 F |

*Primary Examiner*—Bernard A. Gelak
*Attorney, Agent, or Firm*—O'Brien & Marks

[57] ABSTRACT

A bottom stop for a slide fastener includes tape reinforcing members on opposite sides of each mounting tape joined by a connecting plug extending through a hole in the mounting tape.

1 Claim, 2 Drawing Figures

FIG. 1
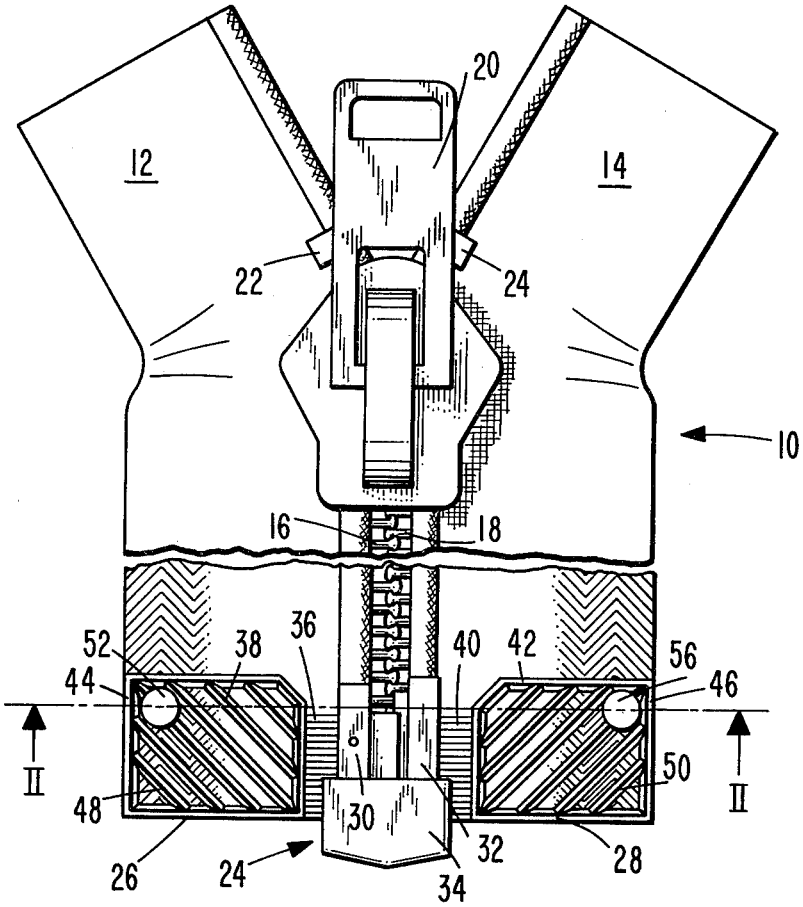
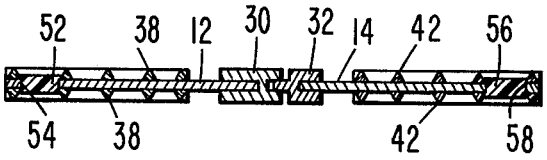
FIG. 2

TAPE REINFORCEMENTS FOR SLIDE FASTENERS

BACKGROUND OF THE INVENTION

1. Field of the Invention

The present invention relates to a slide fastener installation in which the tape reinforcing members are permanantly prevented from peeling from the mounting tapes.

2. Description of the Prior Art

The prior art, as exemplified by U.S. Pat. Nos. 3,377,668 and 3,616,939, is generally cognizant of slide fastener separable bottom stop elements in which tape reinforcing members are provided to stiffen the bottom of the mounting tapes to aid in separating and joining the bottom stop elements. Heretofore it has been a problem in the art that these tape reinforcing members would tend to peel away from the mounting tapes after extended wear and repeated launderings. The present invention solves this difficulty and insures that the tape reinforcing member will remain fixed to the mounting tapes.

SUMMARY OF THE INVENTION

The present invention is summarized in that a slide fastener installation includes first and second mounting tapes, a chain of coupling elements mounted on adjacent edges of each of the mounting tapes, a slider entrained on the chains of coupling elements and movable along them to engage and disengage the coupling elements in the chains, a bottom stop leg portion on each tape to receive the slider thereon at one extreme of its movement along the chains, a tape reinforcing member extending on each side of each tape away from the leg portions and a connecting plug connecting the tape reinforcing members on the opposite sides of each tape to prevent the tape reinforcing members from separating from the mounting tapes.

It is an object of the invention to provide a slide fastener installation with tape reinforcing members in which the tape reinforcing members are prevented from peeling away or separating from the mounting tapes.

It is a further object of the invention to prevent the tape reinforcing members from peeling without the necessity of radical design change or increase in production or material costs.

Further objects, advantages and features of the invention will become apparent from the following description when taken in conjunction with the accompanying drawings.

BRIEF DESCRIPTION OF THE DRAWINGS

FIG. 1 is a front elevation view of a slide fastener installation according to the present invention.

FIG. 2 is a cross section along the line II—II in FIG. 1.

DESCRIPTION OF THE PREFERRED EMBODIMENTS

As shown in FIG. 1, the present invention is embodied in a slide fastener generally indicated at 10. The slide fastener 10 includes a pair of mounting tapes 12 and 14. Each of the mounting tapes 12 and 14 has mounted on its edge a chain of slide fastener coupling elements 16 and 18. It is envisioned that the chain of coupling elements 16 and 18 may be of any suitable material and of any suitable type of slide fastener coupling element but it is preferred that the chains of the coupling elements 16 and 18 be either of a coil or meander type configuration formed of a continuous thermoplastic filaments as is well known to the art. A slider 20 is mounted on the slide fastener 10 and travels up and down the coupling element chains 16 and 18 to engage and disengage the coupling elements. A pair of top stops 22 and 24 limit upward movement of the slider 20.

A bottom stop, generally indicated at 24 limits downward movement of the slider 20. The bottom stop 24 may be made of any suitable material, but is preferrably entirely constructed from a thermoplastic resin. The bottom stop 24 includes a bottom stop element 26 mounted on the tape 12 and a bottom stop element 28 mounted on the tape 14. The bottom stop elements 26 and 28 each have a leg portion 30 and 32 to receive the slider 20. The bottom stop element 26 has a retainer 34 attached to the leg portion 30 and adapted to receive the leg portion 32 when the bottom stop elements 26 and 28 are joined. A connecting portion 36 joins the leg portion 30 with tape reinforcing member 38 in the bottom stop element 26 while a connecting member 40 joins the leg portion 32 with a tape reinforcing member 42 in the bottom stop element 28. The tape reinforcing members 38 and 42 have respective peripheral ribs 44 and 46 extending around their periphery. Inside the peripheral ribs 44 and 46 and extending from one side to the other of the tape reinforcing members 38 and 42 are diagonal ribs 48 and 50.

As is best shown in FIG. 2, the leg portions 30 and 32 extend around the edge of and onto both sides of the tapes 12 and 14. The connecting members 36 and 40 and the tape reinforcing members 38 and 42 are duplicated on opposite sides of the tapes 12 and 14. The tape reinforcing members 38 on opposite sides of the tape 12 are joined together by a connecting plug 52 which fills a hole 54 in the tape 12. The connecting plug 52 is located adjacent the outside edge of the tape 12 just inside the peripheral rib 44 and is an integrally formed extension of both the tape reinforcing members 38 on the opposite sides of the tape 12. Similarly a connecting plug 56 fills a hole 58 in the tape 14 and is integrally formed with and joins together the tape reinforcing members 42 on the opposite sides of the tape 14.

The connecting plugs 52 and 56 serve to prolong the serviceable life of the bottom stop 24 by keeping the pairs of tape reinforcing members 38 and 42 from splitting apart. By joining the pairs of tape reinforcing members 38 and 42 on opposite sides of the tapes 12 and 14, the connecting plugs insure that the tape reinforcing members cannot peel away from the mounting tape and thus weaken or destroy the bottom stop. And since the connecting plugs 52 and 56 are integrally formed between the pairs of tape reinforcing members 38 and 42, there is very little or no chance that they could become separated from them, even after extended use and great wear. All this is accomplished with little or no increase in the cost or complexity of the slide fastener installation inasmuch as all that is necessary in the construction of the bottom stop 24 to provide for the connecting plugs 52 and 56 is for the properly positioned holes 54 and 58 to be provided in the mounting tapes 12 and 14. Customarily, bottom stops are, as is well known in the art, molded onto both sides of the mounting tapes and it requires no new manufacturing steps to fill the holes 54 and 58 with the same thermoplastic material being used to construct the tape reinforcing members 38 and 42 to form the connecting plugs 52 and 56. Thus an advantageous improvement is accomplished with little or no cost either in the production machinery or the raw material used.

Inasmuch as many modifications, variations and changes in minor detail are possible to the described preferred embodiment, it is intended that all matter in the foregoing description and accompanying drawings be interpreted in an illustrative rather than a limiting sense.

What is claimed:

1. A slide fastener installation comprising first and second mounting tapes, each of the tapes having inner and outer edges and a hole adjacent the outer edge of the tape, a plurality of coupling elements secured to the inner edge of each of the tapes, a slider entrained on said coupling elements and being movable therealong to engage and disengage the coupling elements, a bottom stop including first and second bottom stop elements, each having a leg portion to receive the slider thereon, each of the bottom stop elements including tape reinforcing members on opposite sides of each mounting tape extending away from the leg portions, and a connecting plug extending through and filling the hole in each mounting tape, each connecting plug being integrally formed with and joining together the tape reinforcing members on the opposite sides of each tape to insure that the tape reinforcing members cannot peel away from the outer edge of its mounting tape.

* * * * *